United States Patent [19]

Yamauchi et al.

[11] 3,935,701

[45] Feb. 3, 1976

[54] WRISTWATCH WITH A TIME DISPLAY CONTROL SWITCH MEANS

[75] Inventors: Masamichi Yamauchi, Ichikawa; Makoto Yoshida, Tokorozawa; Yasuaki Nakayama, Higashi-kurume, all of Japan

[73] Assignee: Citizen Watch Co., Ltd., Tokyo, Japan

[22] Filed: Mar. 25, 1974

[21] Appl. No.: 454,481

[30] Foreign Application Priority Data

| | | |
|---|---|---|
| Mar. 26, 1973 | Japan | 48-34375 |
| June 13, 1973 | Japan | 48-66485 |
| July 9, 1973 | Japan | 48-77315 |
| July 6, 1973 | Japan | 48-79763[U] |

[52] U.S. Cl. ..... 58/50 R; 58/23 R; 200/61.52

[51] Int. Cl.[2] ..... G04B 19/34

[58] Field of Search ..... 58/23 R, 23 BA, 50 R; 200/DIG. 2, 61.52; 240/6.43

[56] References Cited

UNITED STATES PATENTS

| | | | |
|---|---|---|---|
| 3,161,737 | 12/1964 | Hall | 200/61.52 |
| 3,729,923 | 5/1973 | Brigliano et al. | 58/50 R |
| 3,742,699 | 7/1973 | Bergey | 58/23 R |
| 3,748,847 | 7/1973 | Kouchi | 58/50 R |
| 3,855,784 | 12/1974 | Foellner | 58/50 R |

FOREIGN PATENTS OR APPLICATIONS

| | | | |
|---|---|---|---|
| 120,324 | 9/1945 | Australia | 200/61.52 |
| 648,661 | 12/1928 | France | 200/61.52 |

*Primary Examiner*—L. T. Hix
*Assistant Examiner*—U. Weldon
*Attorney, Agent, or Firm*—Sughrue, Rothwell, Mion & Zinn

[57] ABSTRACT

An electronic watch having an illuminating time display is provided with a switch for controlling the illumination which is operable controlled movement of the arm on which the watch is carried. A closed casing in the watch is provided with electrical contacts and a ball which will engage the contacts to close the watch upon predetermined movement of the arm.

1 Claim, 11 Drawing Figures

WRISTWATCH WITH A TIME DISPLAY CONTROL SWITCH MEANS

This invention relates to the control technique for illuminating time display means on a solid state arm watch. More specifically, it relates to improvements in and relating the switching means for use with the time display means of the above kind.

Recently, those skilled in the art have devoted themselves sincerely in the development of electronic watches which do not utilize an electro-mechanical oscillator as the parent time base frequency generator means. Most frequently, the quartz type high frequency oscilllator is being used broadly as the frequency standard, so as to cooperate with frequency converter means adapted for generating the required electric signals suitable for proper time counting.

When, however, the oscillator and the frequency converter are intended to combine with each other in such a manner that the necessary frequency stabilization is guaranteed at a reduced source power consumption and with miniatured overall dimensions, substantial difficulty has been encountered. As an endeavoir for overcoming this difficulty, an improved quartz oscillator type watch movement with use of a small power complementary MOS-circuit was proposed as by the disclosure in U.S. Pat. No. 3,560,998 granted Feb. 2nd, 1971. According to this disclosure, the proposed combination of the oscillator with the frequency converter is adapted for use not only to drive conventional time display hands on the dial, but also to selectively energize the illuminatable display elements of an optical time display unit, in response to the output signal from the converter.

As a further prior art, U.S. Pat. No. 3,576,099, granted Apr. 27, 1971 discloses an improved timepiece having such optical display means comprising a plurality of illuminating diodes energizable intermittently depending upon the watch user's demands. By adopting such means as above, a minimized power consumption and a substantially prolonged durable life of the source battery could be realized.

A further improvement has been proposed to control the illuminating operation of the optical time display unit by use of a gravity-controlled switch fitted on the electronic timepiece when the watch user operates this kind of switch by intentional movement of the human arm. However, the random movements of the watch-carrying arm may frequently cause the operation of the switch which results in a substantial increase in the power consumption of the source battery.

It is therefore a main object of the invention to provide a highly improved operation control means for the illuminatable time display unit and adapted for substantial identification of intentional human arm movement from random one so as to minimize otherwise increased source power consumption.

It is a further object of the invention to provide the improved operation control means of the above kind which can energize illuminatable time display unit by positioning the watch-carrying human arm at selected two successive positions intentionally by the watch user.

These and further objects, advantages and features of the present invention will appear more apparent when read the following detailed description of the present invention by reference to the accompanying drawings:

Referring now to the accompanying drawings, several preferred embodiments of the present invention will be disclosed in detail.

Figure 1:
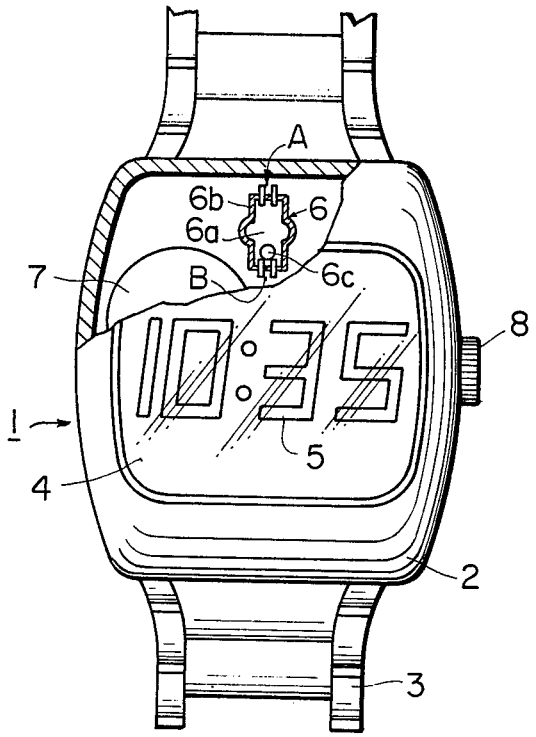
FIG. 1 is a partially broken-away plan view of an electronic watch fitted with an improved arm motion-operated switch according to this invention.

In FIG. 1, numeral 1 represents generally a watch to which this invention has been applied. Numeral 2 represents a watch case of the watch which is a standard size men's watch.

As seen from FIG. 1, the watch case 2 is connected mechanically as usual with end extremities of a watch band 3, although the connecting mode has been omitted from the drawing because it does not constitute any part of the invention.

The watch 1, having the known type of solid state watch movement, although not specifically shown, is formed with a display window through which a digital time display "10:35" is representatively visible as shown at 5.

Within the watch 1, there is provided an arm-position-operated switch 6 which can be brought into its on-position when the watch-carrying person intends to know the present time by adopting two successive specifically selected positions of his watch-carrying arm, as will be more fully described hereinafter, thereby bringing the time display unit 5 into its energized state.

Figure 3:
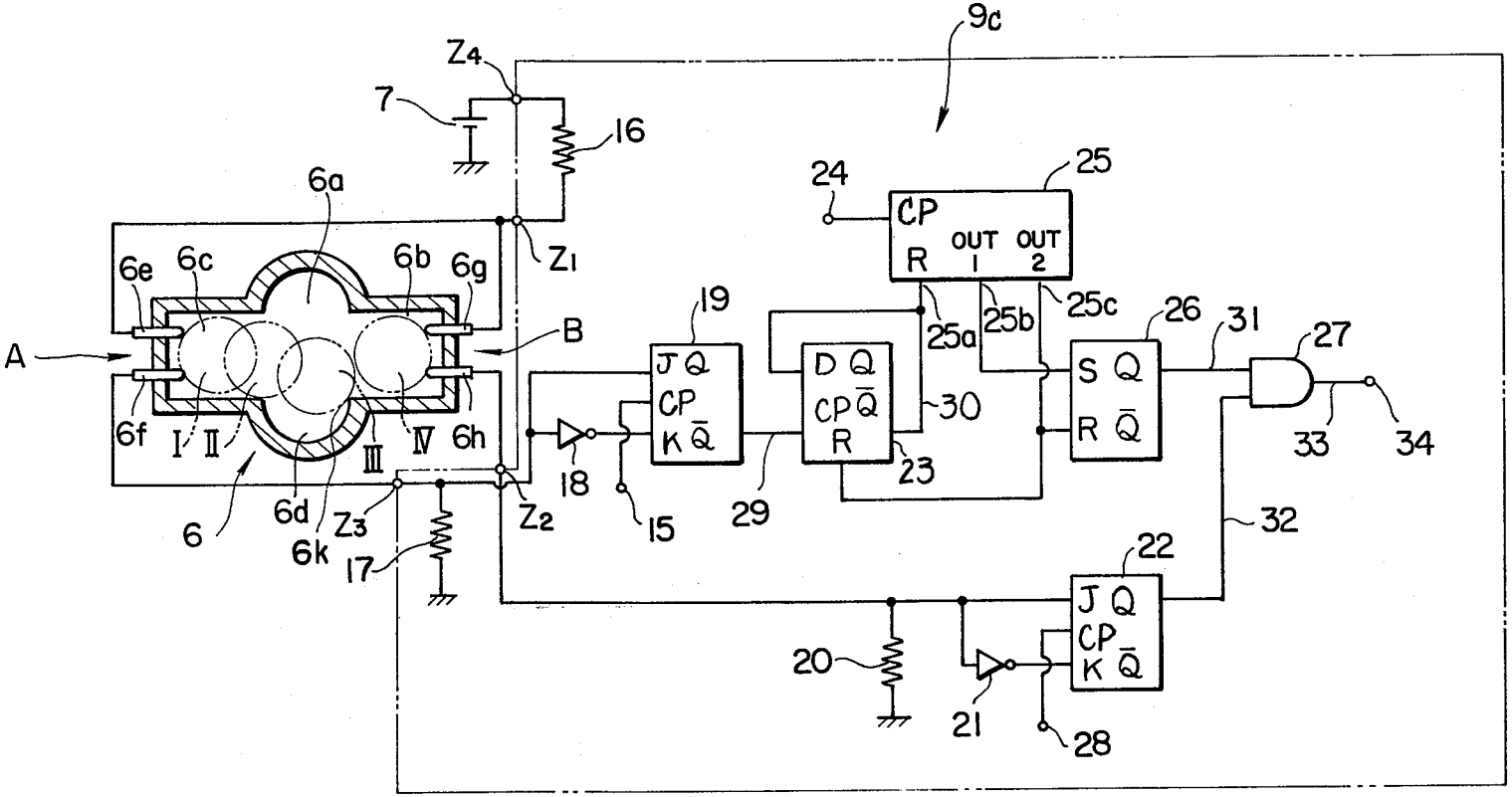
FIG. 3 is a schematic connection diagram of a control circuit for cooperation with said arm motion-controlled switch.

The switch 6 shown in FIGS. 1 and 3, comprises a sphero-cylindrical hollow case member **6*b* constituted by an insulating plastic material and having a substantially spherical hollow space 6*a*. As seen most clearly in FIG. 3, the case member 6*b* are closed at its both cylindrical ends A and B. At the left-hand end A, there is a pair of terminals 6*e* and 6*f* passing from outside through the related end wall and projecting into the cylindical inner space of the case member 6*b*. In the similar way, at the opposite or right-hand end B, a pair of terminals 6g and 6h passes from outside through the related end wall and projects into the cylindrical inner space of the case member in opposite manner to the first pair of terminals 6e and 6f. A conductive metallic ball piece 6c is inserted in the inside hollow space 6a of the case member 6b in a floatable manner, so as to occupy several different positions as at I, II, III and IV shown in FIG. 3. As will become clearer as the description proceeds, the terminal pair 6e and 6f at the end A of the case member can be brought into electrical contact with the ball piece 6c if the upper side of the watch, when seen in FIG. 1, has been positioned downwards in the gravity direction. On the other hand, if the lower side of the watch, when seen in FIG. 1, has been positioned downwards in the gravity direction, the ball piece is brought into electrical contact with the opposite terminal pair 6g; 6f**.

Numeral 7 represents a small size button battery, as partially and schematically shown in FIG. 1 in its outline configuration and in its electrical nature in FIG. 3.

At the right-hand side of the watch case 2, when seen in FIG. 1, there is provided a conventional time-setting crown 8.

Figure 2:
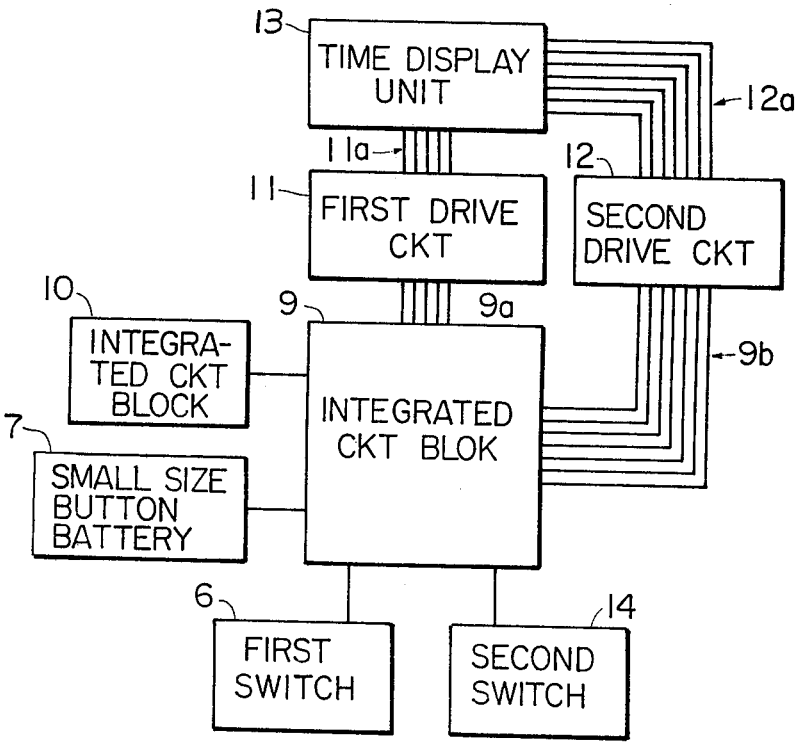
FIG. 2 is a block diagram showing several electrical and electronic parts of the electronic watch, adapted for cooperation with said arm motion-operated switch shown in FIG. 1.

In the block diagram shown in FIG. 2, a rectangular block 9 represents an integrated circuit comprising a complementary MOS-transistor. Numeral 10 represents only schematically a electromechanical vibrator comprising a quartz oscillator and condenser means and being connected with an oscillating and amplifying circuit, not shown, included in the integrated circuit block 9, thereby acting as a precise time base adapted for delivery of a predetermined precise frequency output such as of 32,768 Hz. This precise frequency output signal is in a series of frequency divides, not shown, included in the integrated circuit for delivery of 1 Hz-signal output as the time base. Such time base signal generating mechanism is, however, conventionally well known. The 1 Herz-output signal is subjected to decoding and conversion as conventionally known, by being supplied to counter circuit means, decoder means and the like, not shown, including in the integrated circuit block 9. The thus processed signals are taken out from the block 9 and fed through conductor means 9a and 9b to drive circuits 11 and 12, shown only schematically by respective blocks. Electric output signals are fed from the drive circuit 11 through conductor means 11a to units representing illuminating diode, not shown, and included in a time display unit 13. The drive circuit 11 or 12 comprises bipolar transistor means, not shown. The time display unit 13 comprises an hour section, a minute section, and a colon section or seconds section, as shown more specifically by a representative time indication "10:35" in FIG. 1. Each section may constitute a plurality of illuminating diodes, as conventionally known, although not specifically shown. The electrodes of these illuminating diodes are electrically connected with the drive circuit 11.

On the other hand, the other drive circuit 12 is electrically connected through conductor means 12a to the electrodes of illuminating diode segments which are capable of representing time-display figures at the time display unit 13. Each of these figures is of the known seven-segments design.

Numeral 7 represents a battery acting as the energy source for all the electrically operatable watch constituents and connected electrically with the integrating circuit block 9.

Numeral 14 represents a correction switch, shown again only schematically in a block and connected with the integrating circuit block 9 for occasional correcting of minute and hour time representations. This switch 14 may be identical with the time-setting crown 8 shown in FIG. 1.

Within the integrated circuit block 9, there is provided a control circuit shown at 9c in FIG. 3 in which the arm-position- or gravity controlled switch 6 shown in FIGS. 1 and 2, is illustrated in a more specific manner, said gravity controlled switch being positioned at a proper position outside of the circuit 9c.

In FIG. 3, a first terminal Z1 of the control circuit 9c is electrically connected in parallel with said terminals 6e and 6g. Second and third terminals Z2 and Z3 of said control circuit are electrically connected with said terminals 6h and 6f, respectively. Fourth terminal Z4 is connected with the positive pole of said source battery 7.

The sphero-cylindrical case member 6b of switch 6, being made of plastic resin material has its inside space 6a having a semi-spherical enlargement 6d. The metal ball 6c is shown at four different positions I, II, III and IV in imaginary lines. Cylindrical ends of the case are shown at A and B, respectively, as was referred to.

Now, it is assumed that the ball 6c occupies at first position 1 thereof which position corresponds to such position that the upper end of watch, FIG. 1, directs downwards, while the lower end of the watch directs upwards. When the watch user intends to know the present time at this position of the watch, then he turns his left hand on which the watch 1 is carried, clockwise when seen from his body side, at least about 60° and at a rather slow speed. By this operation, the first position I through its second and third positions II and III to the fourth position IV where the terminal pair 6g; 6h is closed.

In the control circuit 9c, FIG. 3, the following constituents are included which are connected one after another as shown.

- 15 . . . a terminal which is electrically connected with a properly selected intermediate stage of the frequency divider series, not shown;
- 16 . . . a resister element, preferably of 1 megohm;
- 17 . . . a resister element preferably of 5 megohms;
- 18 . . . an inverter;
- 19 . . . a flip-flop, of J-K type;
- 20 . . . a resister element, preferably of 5 megohms;
- 21 . . . an inverter;
- 22 . . . a J-K type flip-flop;
- 23 . . . a D-type flip-flop;
- 24 . . . a terminal connected with a properly selected intermediate stage of the frequency divider series, not shown;
- 25 . . . a counter;
- 26 . . . a R-S type flip-flop;
- 27 . . . an AND-gate;
- 28 . . . a terminal connected with a properly selected intermediate stage of the frequency divier series, not shown;
- 34 . . . an output terminal.

Inverter 18 is connected across J- and K-inputs of flip-flop 19. In the similar way, inverter 21 is connected across J- and K- inputs of flip-flop 22. Inlet of inverter 18 is connected with said terminal Z3 which is in turn connected with said terminal 6f. Inlet of inverter 21 is connected with said terminal Z2 which is in turn connected with said terminal 6h. Terminal Z1 is connected in parallel to said terminals 6e and 6g, on the one hand, and to one end of said resister 16, on the other. Terminal Z4 is connected to the opposite end of the latter, on the one hand, and to the positive side of source battery 7, on the other.

Flip-flops 19 and 22 have respective CP-inlets which are connected to terminals 15 and 28, respectively, for reception of clock pulses.

$\overline{Q}$-output of flip-flop 19 is connected through a lead 29 to CP-inlet of flip-flop 23.

$\overline{Q}$-output and D-inlet of flip-flop 23 are connected with each other and said $\overline{Q}$-output is further connected through a lead 25a to reset terminal R of counter circuit 25 which has an inlet CP and output terminals OUT-1 and OUT-2. The CP-inlet is connected with said terminal 24 for reception of clock pulses. OUT-1 is connected through a lead 25b to setting input terminal S of said flip-flop 26. OUT-2 is connected through a lead 25c in parallel to reset input terminals R of flip-flops 26 and 23, respectively.

Output terminal Q of flip-flop 26 and output terminal Q of flip-flop 22 are connected through leads 31 and 32 to inlets of AND-gate 27, respectively, output of the latter being connected through a lead 33 to said output terminal 34.

Figure 4:
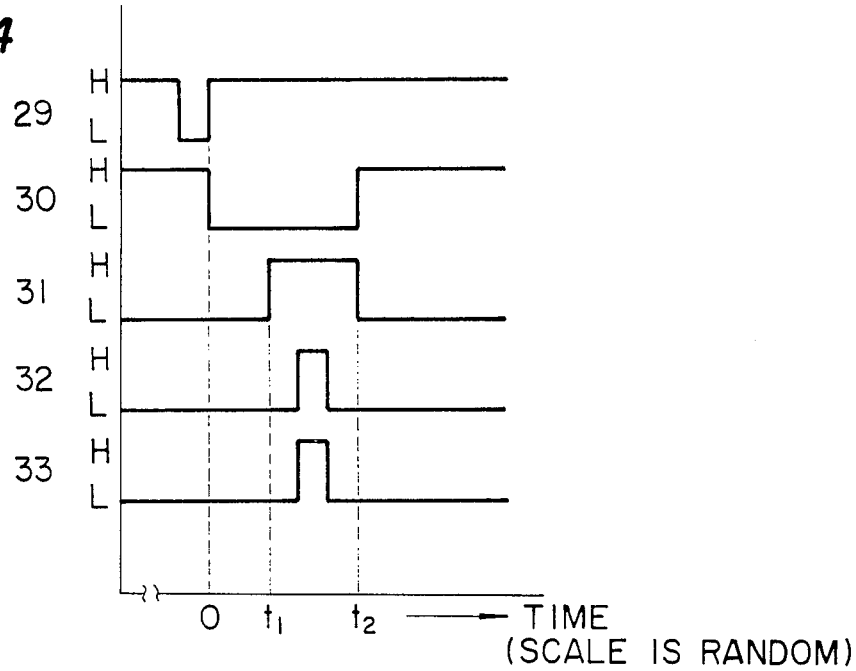
FIG. 4 is a chart showing several wave forms appearing in the control circuit shown in FIG. 3.
Figure 5:
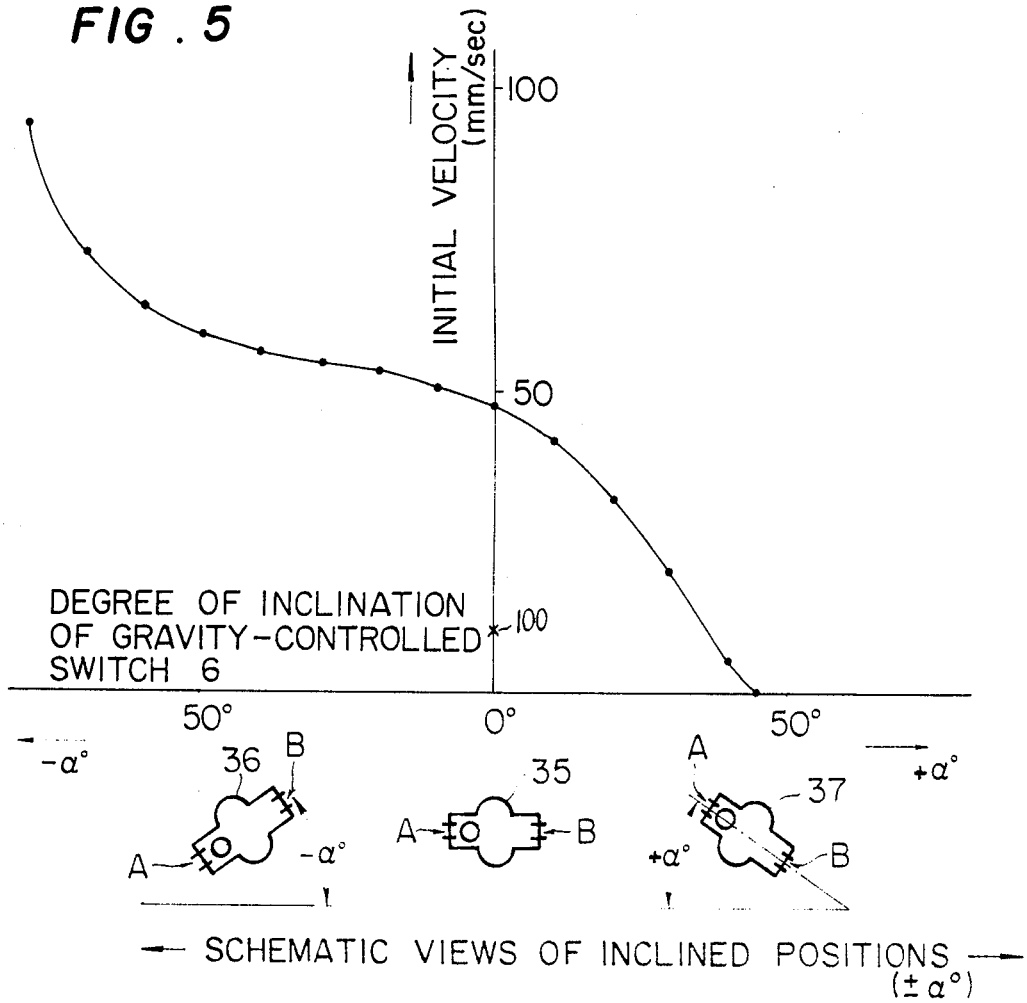
FIG. 5 is a diagram showing initial velocity of the ball included in the arm motion-operated switch, plotted against the inclination of the switch arm from the horizontal.

The operation of the arrangement shown in FIG. 3 will be briefly described hereinbelow in consultation of FIG. 4 showing wave forms appearing at several points in the circuit portion shown in FIG. 3.

With the ball 6c positioned at I in FIG. 3, terminals 6e and 6f at the end A are electrically connected with each other as shown. Upon establishment of this conducting state, the output from flip-flop 19 appearing at 29 will change its state from higher logic level "1," say 1.5 volts, hereinafter to be called as "H-level," to lower logic level "O". say zero volt, hereinafter to be called as "L-level," as specifically illustrated at 29 in FIG. 4.

If the ball 9c is separated from the cylinder wall end A, thus the above established contact between the related terminal pair 6e; 6f, the state of output from flip-flop 19 will be logically reversed from L-level to H-level. At this moment, output from flip-flop 23 will be changed from H-level to L-level, as may clearly seen at 30 in FIG. 4, thereby the counter 25 being brought into its counting operation.

Upon counting a predetermined number of clock pulses for establishing a time delay, say 0.5 second, by the counter 25, arriving at a time point *t*shown in FIG. 4, an output signal will be delivered therefrom through first output OUT-1 and lead 25b to S-input of flip-flop 26, so as to convert its Q output to H-level, as specifically illustrated at 31 in FIG. 4.

Upon further counting a predetermined number of clock pulses for establishing a reset operation to be described, for a predetermined operation period $t2 - t1$, say 0.2 second, an output signal will be delivered from OUT-2 through lead 25c to R-inputs of flip-flops 23 and 25. Thus, the output from flip-flop 26 is converted from H- to L-level, as specifically illustrated at 31 in FIG. 4. At the same time, the output from flip-flop 23 is reset at $t2$ to H-level, thereby the counting operation at 25 being terminated and reset to its off-operation state.

During the time period $t2 - t1$ where the output from flip-flop 26 is kept at H-level, and if the ball 6c is positioned at fourth position IV, establishing the conducting state between the terminal pair at the opposite cylinder end wall B, the output from the flip-flop 22 at 32 is at its H-level and thus the output from AND-gate 27 at 33 and 34 is at its H-level. The output terminal 34 is connected through a pulse width setting circuit, not shown, which may preferably be an electronic counter having similar design to that shown at 25, and being included in the block 9, with the drive circuit 11, FIG. 2. During delivery of this output signal from the drive circuit 11, the illuminatable time indication unit 13 can be energized, say, each time for 2 seconds.

In the foregoing description, the switching operation at 6 has been brought about, but under occasion, an unintentional movement of the watch user's left hand may bring about a similar effect which must be avoided as far as possible.

With such unintentional left hand movement, the ball 6c could move from its first position through second and third positions II and III. Under intentional switching movement by use of the watch user's left hand arm at a rather longer time period, the ball will drop into the semi-spherial recess 6d under gravity action during the transit movement from II to III. Generally speaking, the ball 6c may frequently move from I directly to IV and IV to I by various unintentional movements of the left hand arm, and indeed, at a rather rapid moving speed. Under certain lesser occasions, the ball will go from I through II and III to IV, upon impinging upon the edge 6k. This phenomenon is also included in the above mentioned unintentional switching operation.

Since the intentional switching operation through the ball once dropped by gravity into the recess 6d extends for 0.5 – 0.7 second with reasonable safety, substantial unintentional switching possibility caused by random arm movement can be excluded from occurrence by masking off the rather rapid switching periods, because such incorrect switching may be carried out rather rapidly and mostly less than 0.5 second when considering the switching ball movement in the specific embodiment as being disclosed.

In the foregoing first embodiment shown in FIGS. 1 –4, the ball 6c is preferably made of cast iron and galvanized on its surface with gold. Radius is of 1.6 mm. The outer axial distance between the both end walls A and B is about 5.2 mm. The inside diameter of the cylindrical portion of switch case 6b is 1.8 mm. The radius of the spherical recess at 6d is 2.5 mm. Max. inside diameter is 6.8 mm.

As the results of practical experiments, the practically employable swivel or turning angle of the watch-carrying arm adapted for execution of the foregoing intentional switching operation has been set to 135°–180°.

In the chart, the graph shows the initial velocity of the metallic ball 6c necessary for travel thereof between the case ends A and B, plotted against the inclination angle plus and minus alpha degrees of the gravity-controlled switch unit 6 relative to the watch positioned horizontal, as met at random moments of a human watch-carrying arm and in the first embodiment shown in FIGS. 1 – 4, when the switch case 6b is made of metal. In practice, however, with use of switch case made of a plastic resin, say acrylic one, and in comparison therewith, the highest initial velocity for intentional arm motion for energization of the illuminatable time display unit 5 must preferably be about 10 mm/sec as shown by a cross at 100 on the axis of ordinate. At 35, 36 and 37, three different angular positions of the switch unit as shown only schematically.

Figure 6A:
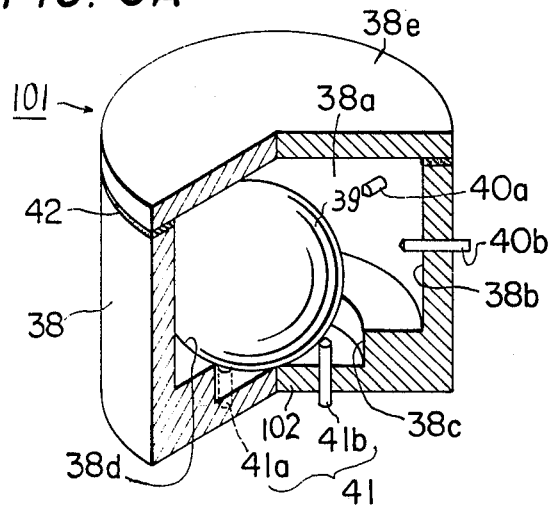
FIG. 6A represents a partially broken-away perspective view of a second embodiment of the arm motion-controlled switch.
Figure 6B:
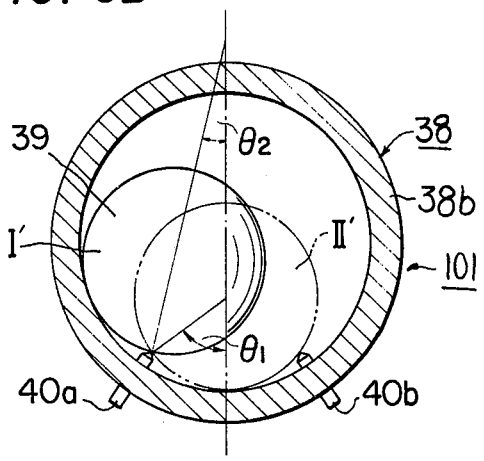
FIG. 6B is a schematic cross-section of the switch shown in FIG. 6A.
Figure 6C:
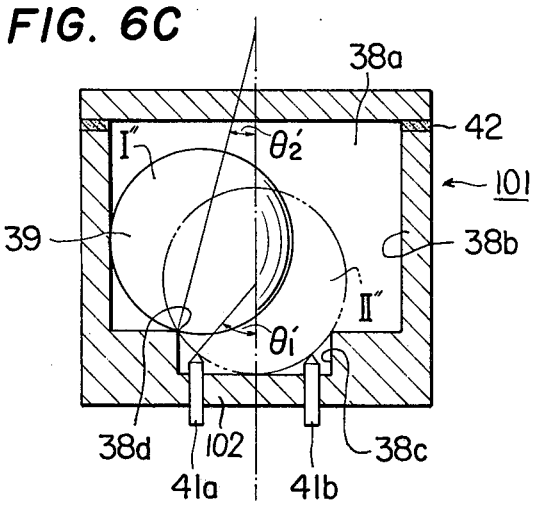
FIG. 6C is a schematic axial and vertical section of the switch shown in FIG. 6A.

In FIGS. 6A – 6C, a second embodiment of the ball type gravity-controlled switch is shown at 101.

In these figures, numeral 38 is a switch case which has been replaced for that shown at 6*b*, and made of again a plastic resin material, and fabricated into a bottom closed hollow cylinder, the open upper end of which is sealedly attached with a plastic cover 38*e*, the glueing layer therebetween being shown at 42. The interior of the case 38 is formed into a stepped hollow space 38*a* which contains therein a freely movable iron ball 39. The case 38 is formed with a larger diameter cylindrical wall portion 38*b*, through which a pair of projecting stationary contacts or terminals 40*a* and 40*b*, and with a smaller diameter cylindrical shoulder portion 38*c* forming a closing thicker bottom wall.

A circular central thinner bottom wall portion 102 is defined by the inner periphery nearly at the bottom end of said thicker wall portion 38*c*. A pair of stationary contacts or terminals 41*a* and 41*b*, being shown jointly by numeral 41 passes through the thinner bottom wall portion 102. All these figures 6A - 6C, the gravity directs always downwards.

In FIG. 6B, the ball 39 is shown about to roll along the inside wall surface of the larger diameter cylinder portion 38*b* from its full line position into its dotted-chain line position or from I′ to II′. At the first position I′, the ball is kept in contact with the terminal 40*a* only, while in its chain-dotted line position II′, the ball is kept in contact with the contact pair 40*a* 40*b* which is thus brought into its conducting state.

Now assuming that the inside radius of the larger cylinder portion 38*b* is denoted by R1 and that the radius of iron ball 39 is represented by *r*, and further that $\theta 1$ represents the included angle between a radius of the ball at II′, passing through said contact 40*a*, while $\theta 2$ represents that included between an extended diameter of the ball positioned at I′ and passing through the same stationary contact 40*a* when seen in FIG. 6B. According to our experimental results, it has been found that the angle $\theta 1$ should be in the order of 60° or so, in order to utilize the ball weight at I′ as most effective contacting pressure and to realize the most stabilized position of the ball at II′ on and between the contacts 41*a* and 41*b*.

According to our experiment in addition to a theoretical consideration in the present specific second embodiment, the following equation is established:

$$2 \cdot \tan^{-1}\left[\frac{\sqrt{3}\cdot(2R1 - r)}{3}\right] + \theta 2 = \frac{2}{3}\pi \text{ (rad)} \qquad (1)$$

The angle $\theta 2$ may preferably be selected with better experimental results to the order of 15°(± 10°).

Thus, $R1/r = 1.4 - 1.9$

In FIG. 6C, angles $\theta 1'$ and $\theta 2'$ are selected as shown, while *r*1 and *r* are same as before. Further, it is assumed the R2 represents the radius of the central and thinner bottom wall 102. As seen from FIG. 6C, the angle $\theta 2'$ is established relative to the circular edge shown at 38*d* in place of said stationary contact 40*a*. According to our experiments, the angle $\theta 2'$ may be substantially equal to the said angle $\theta 2$. The ball shown in FIG. 6C by its chain-dotted line position II′′ is positioned in the way of four point-supported manner. According to our experiments, better results will be obtained when selecting the angle $\theta 1'$ to 60°– 85°. R2 may preferably be from 0.85 *r* to 1 *r*.

According our experiments in addition to geometrical consideration in this case, the following formula is established:

$$r \cdot \sin \theta 2' + (R1 - r) = R2 \ldots \qquad (2)$$

Thus, $R1/r = 1.4 - 1.9$

Contacts 40*a* and 40*b* can be electrically replaced for said contacts 6*e* and 6*f*, respectively, shown in FIG. 3. In the similar manner, contacts 41*a* and 41*b* can be electrically replaced for said contacts 6*g* and 6*h*, respectively, shown in FIG. 3. The operation of the present second embodiment can easily be understood from consideration of the foregoing detailed description of the first embodiment.

In the above second embodiment, several main dimensions were selected with better results as follows:

| | | | |
|---|---|---|---|
| R1 | 2.6 mm; | R2 | 1.4 mm; |
| r | 1.5 mm; | height at 38c | 0.8 mm; |

Then, the oscillating or intentionally rotating angle of the watch-carrying human arm was preferably selected to 75° – 90° in place of the foregoing recommendable angle range 135° – 180° in the first embodiment.

In the second embodiment, *t*1 was set to 0.2 sec; and *t*2 - *t*1 was selected to 0.4 sec with better results.

Figure 7:
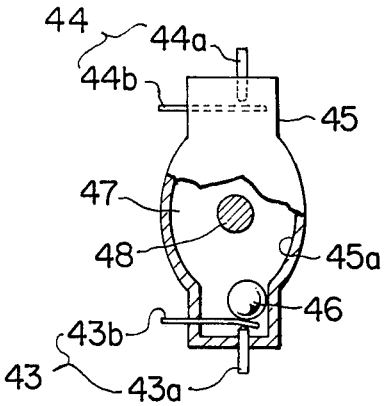
FIG. 7 is a partially broken-away elevation of a third embodiment of the arm motion-controlled switch.

In FIG. 7, a third embodiment is shown.

In this embodiment, the case 45 represents a modified hollow sphero-cylindrical configuration and made of an insulating plastic resin material and having a hollow space at 47. At the middle of the case, there is provided a rigid lateral bar 48 around which the ball shown 46 can travel by rolling movement within said interior space 47.

At the upper closed end of said case 45, a stationary contact or terminal 44*a* is provided, extending in substantially axial direction. A flexible movable contact 44*b* is provided laterally and horizontally, so as to cooperate by its free end with the stationary contact 44*a* when subjected to a vertical pressure to be described.

In the opposite arrangement to said stationary contact 44*a*, a further stationary contact 43*a* is provided at the bottom end of said case, and a resilient movable contact 43*b* is arranged laterally and horizontally, so as to cooperate by its free end with the contact 43*a* when subjected to a downward pressure. When assumed that the gravity action directs downwards in FIG. 7, resilient contact 43*b* makes with stationary contact 43*a* by receiving the ball pressure at 46, while the upper contacts 44*a* and 44*b* are kept off from each other.

Thus, upper contact pair 44 and lower contact pair 43 are substantially complemental in their operational relationship.

It may be well understood from the foregoing description of the third embodiment that the ball 46 is not always made of conductive material.

The lateral bar 48 serves for the prevention of quicker travel of the ball 46 from one end of the case to the opposite one thereof and vice versa by disturbing a direct passage of the ball in this sense. The scheduled round-trip so called of the ball around the bar 48 provides a substantially retarded alternate on-or-off operation at the both contact pairs 43 and 44. Quicker successive on-off operational periods caused substantially by random human arm movements are masked off by use of the control circuit 9*c* in the similar way as before. For this purpose, contacts 43*a* and 43*b* may be replaced for the aforegoing contacts 6*e* and 6*f* in FIG. 3 and so on.

Figure 8:
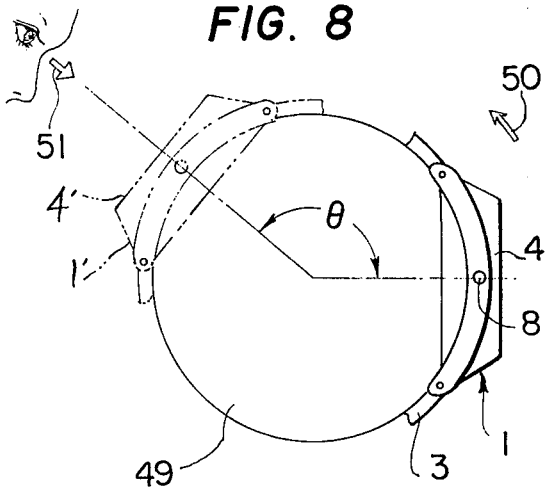
FIG. 8 is a schematic and explanatory view illustrating the mode of an intentional human arm improvement for bringing the improved switch into its operational position.

In FIG. 8, circle 49 represents the watch user's, watch-carrying arm in its cross-section only in a highly schematic way. The watch 1 is seen as attached to said arm 49 by means of conventional arm hand 3. The watch 1 illustrated in full line shows its first position in which the watch user intends to initiate an intentional time display job. The user's eye at this moment directs in the direction as shown by an arrow 51. The central and including angle at the center of the arm cross-section is denoted with $\theta$ in FIG. 8. Thus, the watch is hidden from the viewer's viewing direction. The second or viewable position of the watch is shown at 1' shown in chain-dotted lines wherein the front surface 4 of watch occupies that shown at 4', facing correctly and optimumly towards the viewing eye 51.

The intentional arm-swivelling or revolving angle coincides precisely in this case with the aforementioned central angle $\theta$. The arm-revolving direction is shown by a small arrow at 50.

The shown rotational arm revolving angle and positional range shown and described above are highly optimum and convenient to the watch user and thus, the time-display operation can be carried out in the most convenient and natural way.

Figure 9:
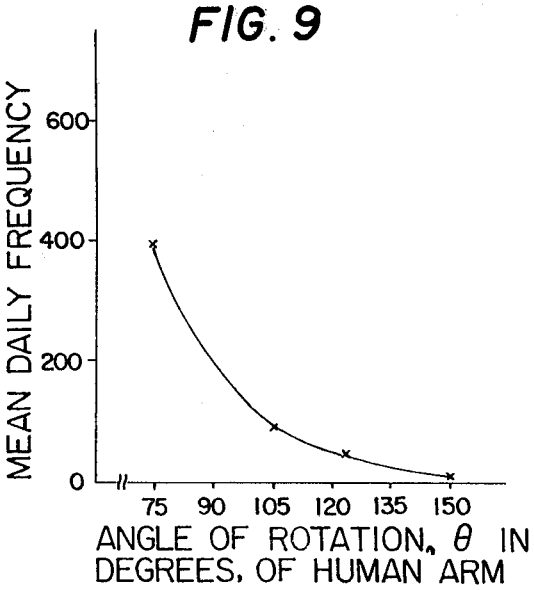
FIG. 9 is a diagram showing the relationship between the mean daily frequency of operation of a illuminatable time display unit carried on a watch and the random and unintentional movements of a human arm.

The diagram shown in FIG. 9 represents mean daily frequency of random movements of the human watch-carrying arm, plotted against the arm rotational angle, so far as the illuminating time display unit has been energized to illuminate, and indeed upon adopting a gravity-operating switch directly controlling the on-off operation of the display unit.

From this diagram, the daily mean frequency will reduce with arm rotational angle increase.

As a representative example, if $\theta = 75°$, the daily occurrence frequency of time-display illumination amounts to about 400. If $\theta = 105°$, the frequency will be about 100. For $\theta$ equal to 125°, it will become about 50 per day-and-night. For $\theta$ equal to 150°, it will amount to about only 10.

It will thus be highly advantages if the gravity-operated switch is caused to operate with a larger angle of rotation of the watch-carrying arm, say 135° – 180° which values are highly linked with the alternative aand complementary on-off-control operation between two pairs of contacts positioned at the inlet to the electronic control circuit as at 9*c*. By adopting these measures, the intentional time-displays can be substantially identified from those caused by the random movements of the human arm. Further, by electronically masking shorter and substantially complementary on-off interval between said two pairs of electrical contacts by use of electronic control means as at 9*c* can improve further substantially the said identification, so as to avoid excess and advantageous consumption of the valuable durable life of the source battery.

The embodiments of the invention in which an exclusive property or privilege is claimed is as follows:

1. An electronic watch comprising an illuminatable time display unit, control means for controlling the energization of said display unit including a switching unit, said switching unit comprising a hollow housing of non-electrically conductive material having a main large chamber and two opposed secondary smaller chambers, electrical switch means disposed in each of said secondary smaller chambers, each of said switch means being comprised of two spaced apart electrically conductive elements and a free-floating electrically conductive ball having a diameter sufficient to contact both of said electrically conductive elements in a chamber when said ball is disposed in said chamber and having dimensions slightly less than the dimensions of the secondary small chambers whereby a controlled movement of the watch wearer's wrist is required for sequentially moving the ball from contact with the conductive elements in one of the secondary smaller chambers to the conductive elements in the other of said secondary smaller chambers in a predetermined time.

* * * * *